US011891713B2

(12) United States Patent
Suzuki

(10) Patent No.: US 11,891,713 B2
(45) Date of Patent: Feb. 6, 2024

(54) SEMICONDUCTOR DEVICE MANUFACTURING JIG AND METHOD FOR MANUFACTURING SAME

(71) Applicants: KABUSHIKI KAISHA TOSHIBA, Tokyo (JP); TOSHIBA ELECTRONIC DEVICES & STORAGE CORPORATION, Tokyo (JP)

(72) Inventor: Takeyuki Suzuki, Kaga Ishikawa (JP)

(73) Assignees: Kabushiki Kaisha Toshiba, Tokyo (JP); Toshiba Electronic Devices & Storage Corporation, Tokyo (JP)

( * ) Notice: Subject to any disclaimer, the term of this patent is extended or adjusted under 35 U.S.C. 154(b) by 0 days.

(21) Appl. No.: 17/412,173

(22) Filed: Aug. 25, 2021

(65) Prior Publication Data

US 2022/0267920 A1 Aug. 25, 2022

(30) Foreign Application Priority Data

Feb. 24, 2021 (JP) ..... 2021-027290

(51) Int. Cl.
*C25D 17/06* (2006.01)
*C25D 7/12* (2006.01)
*C25D 17/00* (2006.01)

(52) U.S. Cl.
CPC ..... *C25D 17/001* (2013.01); *C25D 7/123* (2013.01); *C25D 17/004* (2013.01); *C25D 17/005* (2013.01); *C25D 17/06* (2013.01)

(58) Field of Classification Search
CPC ..... C25D 7/12–123; C25D 17/001; H01L 21/2885; H01L 21/76873; H01L 2224/11462
See application file for complete search history.

(56) References Cited

U.S. PATENT DOCUMENTS 6,423,636 B1 7/2002 Dordi et al.
6,612,915 B1 * 9/2003 Uzoh ..... C25D 7/123 451/286
2002/0195352 A1 * 12/2002 Mayer ..... C25D 17/12 205/687
2021/0028051 A1 1/2021 Noma et al.

FOREIGN PATENT DOCUMENTS

CN 112289762 A 1/2021
JP H10-50638 A 2/1998
JP 5367930 B2 12/2013
JP 5995628 B2 9/2016

OTHER PUBLICATIONS

Takase et al., Original & Machine Translation, JP 2008-088522 A (Year: 2008).*

* cited by examiner

*Primary Examiner* — Hosung Chung
(74) *Attorney, Agent, or Firm* — Kim & Stewart LLP

(57) ABSTRACT

A semiconductor device manufacturing jig for electroplating a substrate includes a conductive member. The substrate includes an inner part including a first surface, and an outer rim part surrounding the inner part. The outer rim part has a ring shape that protrudes further than the first surface in a direction perpendicular to the first surface. The conductive member causes a current to flow in the inner part by contacting a portion of the first surface of the inner part without contacting the outer rim part.

10 Claims, 12 Drawing Sheets

SEMICONDUCTOR DEVICE MANUFACTURING JIG AND METHOD FOR MANUFACTURING SAME

CROSS-REFERENCE TO RELATED APPLICATIONS

This application is based upon and claims the benefit of priority from Japanese Patent Application No. 2021-027290, filed on Feb. 24, 2021; the entire contents of which are incorporated herein by reference.

FIELD

Embodiments relate to a semiconductor device manufacturing jig and a method for manufacturing the same.

BACKGROUND

There is a method in which the decrease of mechanical strength when polishing the back surface of a semiconductor substrate is suppressed by polishing only an inner part of the back surface without polishing an outer perimeter of the back surface. Also, there is a method in which a jig is used to form a metal film by electroplating the back surface of such a semiconductor substrate. In such a method for manufacturing a semiconductor device, it is desirable to suppress manufacturing process defects such as substrate cracks, chipping, etc.

DETAILED DESCRIPTION

Figure 1:
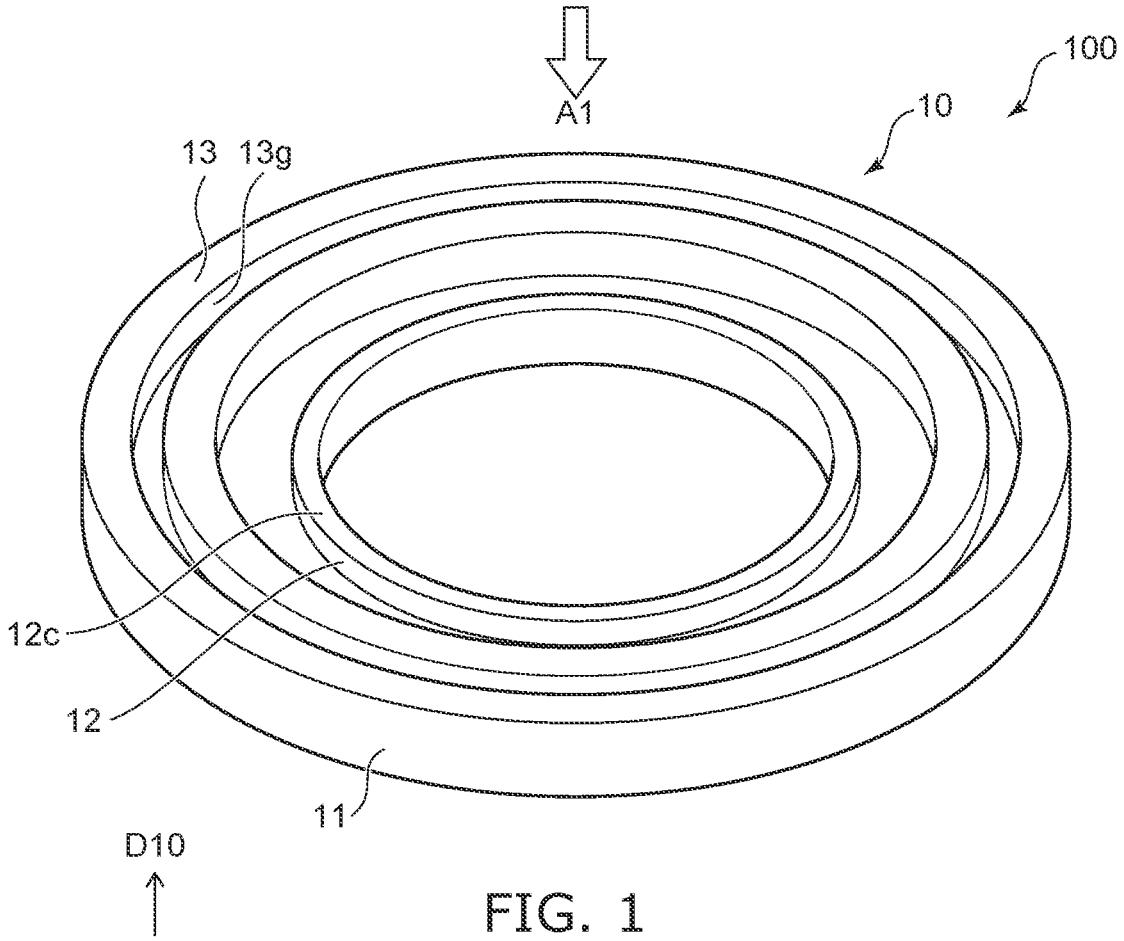
FIG. 1 is a schematic perspective view illustrating a conductive member of a semiconductor device manufacturing jig according to an embodiment.

According to one embodiment, a semiconductor device manufacturing jig for electroplating a substrate includes a conductive member. The substrate includes an inner part including a first surface, and an outer rim part surrounding the inner part. The outer rim part has a ring shape that protrudes further than the first surface in a direction perpendicular to the first surface. The conductive member causes a current to flow in the inner part by contacting a portion of the first surface of the inner part without contacting the outer rim part.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with like reference numerals, and a detailed description is omitted as appropriate.

Figure 2A:
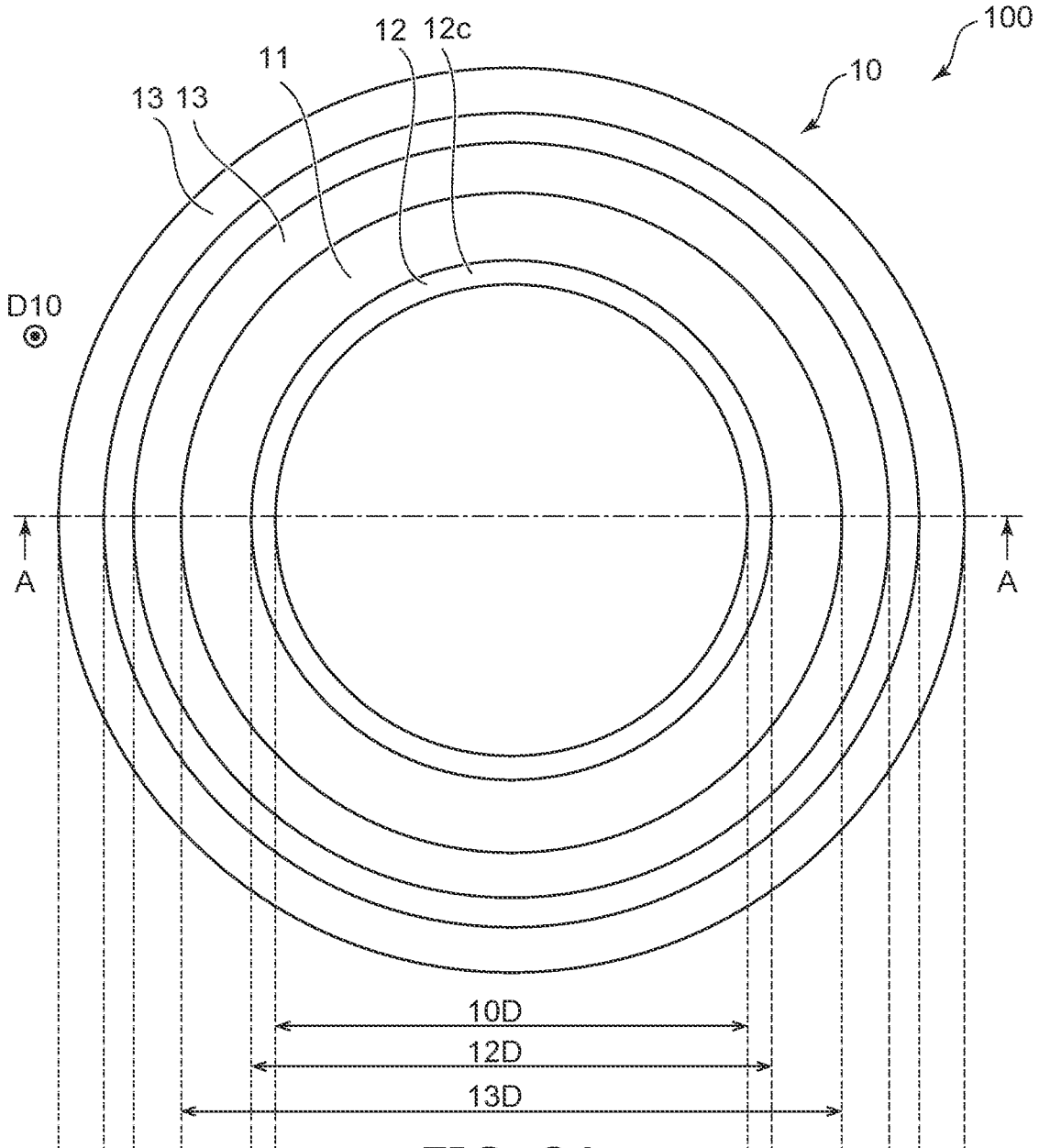
FIGS. 2A and 2B are a schematic plan view and a schematic cross-sectional view illustrating the conductive member of the semiconductor device manufacturing jig according to the embodiment.
Figure 2B:
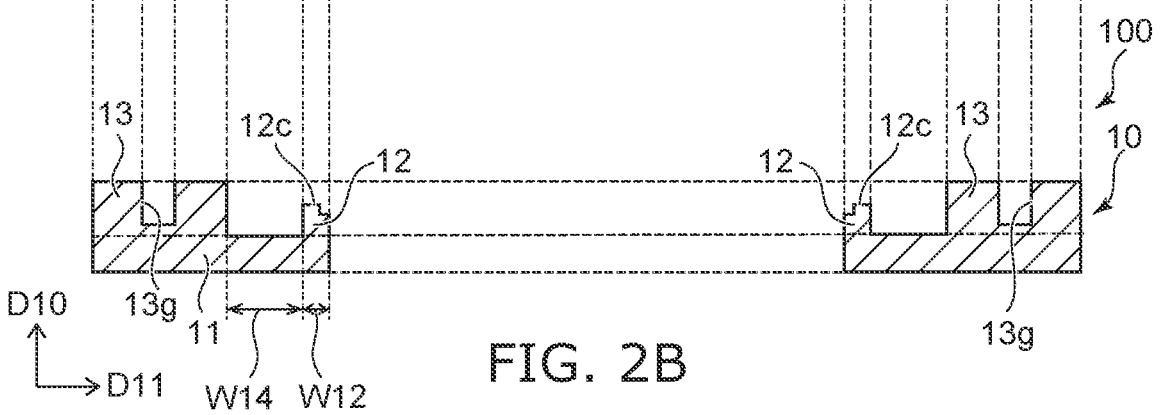

FIG. 1 is a schematic perspective view illustrating a conductive member of a semiconductor device manufacturing jig according to an embodiment. FIGS. 2A and 2B are a schematic plan view and a schematic cross-sectional view illustrating the conductive member of the semiconductor device manufacturing jig according to the embodiment.

The semiconductor device manufacturing jig 100 is a jig for forming a metal film on a substrate by electroplating a semiconductor substrate when manufacturing the semiconductor device. The semiconductor device manufacturing jig 100 includes the conductive member 10 illustrated in FIG. 1, etc. As described below, the semiconductor device manufacturing jig 100 uses the conductive member 10 and a cover member 20 to clamp a substrate 30, and causes a current to flow in the substrate 30 in a plating process (referring to FIG. 5B).

FIG. 2A is a plan view of the conductive member 10 when viewed along arrow A1 illustrated in FIG. 1. FIG. 2B is a line A-A cross section of FIG. 2A.

The conductive member 10 is a ring-shaped member. More specifically, the conductive member 10 includes a first part 11 that is ring-shaped when viewed along a direction D10 shown in FIG. 1. The conductive member 10 further includes a second part 12 and a third part 13 that are located on the first part 11. The second part 12 and the third part 13 are protrusions that protrude in the direction D10 from the first part 11. The second part 12 is located along the inner perimeter of the first part 11. The third part 13 is located along the outer perimeter of the first part 11. The planar shape of the second part 12 and the planar shape of the third part are ring-shaped. The third part 13 surrounds the outer perimeter of the second part 12 and is separated from the second part 12 in a direction D11 perpendicular to the direction D10.

The tip in the direction D10 of the second part 12 is a contact part 12*c* that contacts the substrate to be processed in the plating process. The contact part 12*c* protrudes in the direction D10 with respect to the second part 12 and is located along the outer perimeter of the second part 12. The contact part 12*c* has a constant height and width, and has a continuous ring shape around the entire perimeter of the second part 12. In the plating process, a current flows from the conductive member 10 into the substrate to be processed via the contact part 12*c*. As illustrated in FIG. 2B, the width of the second part 12 may be narrow at the tip of the second part 12.

In the example, a groove 13*g* is formed in the end surface in the direction D10 of the third part 13. The groove 13*g* is continuous around the entire perimeter of the third part 13. As described below, the groove 13*g* is provided so that the conductive member 10 and the cover member 20 can engage. However, according to the embodiment, the groove 13*g* may not always be provided.

For example, the conductive member 10 (the first part 11, the second part 12, and the third part 13) are formed of a metal. The conductive member 10 includes, for example, at least one of iron, chrome, nickel, copper, or aluminum. The conductive member 10 may include, for example, stainless steel. The first part 11, the second part 12, and the third part 13 are, for example, a metal member that is formed to have a continuous body.

Figure 3A:
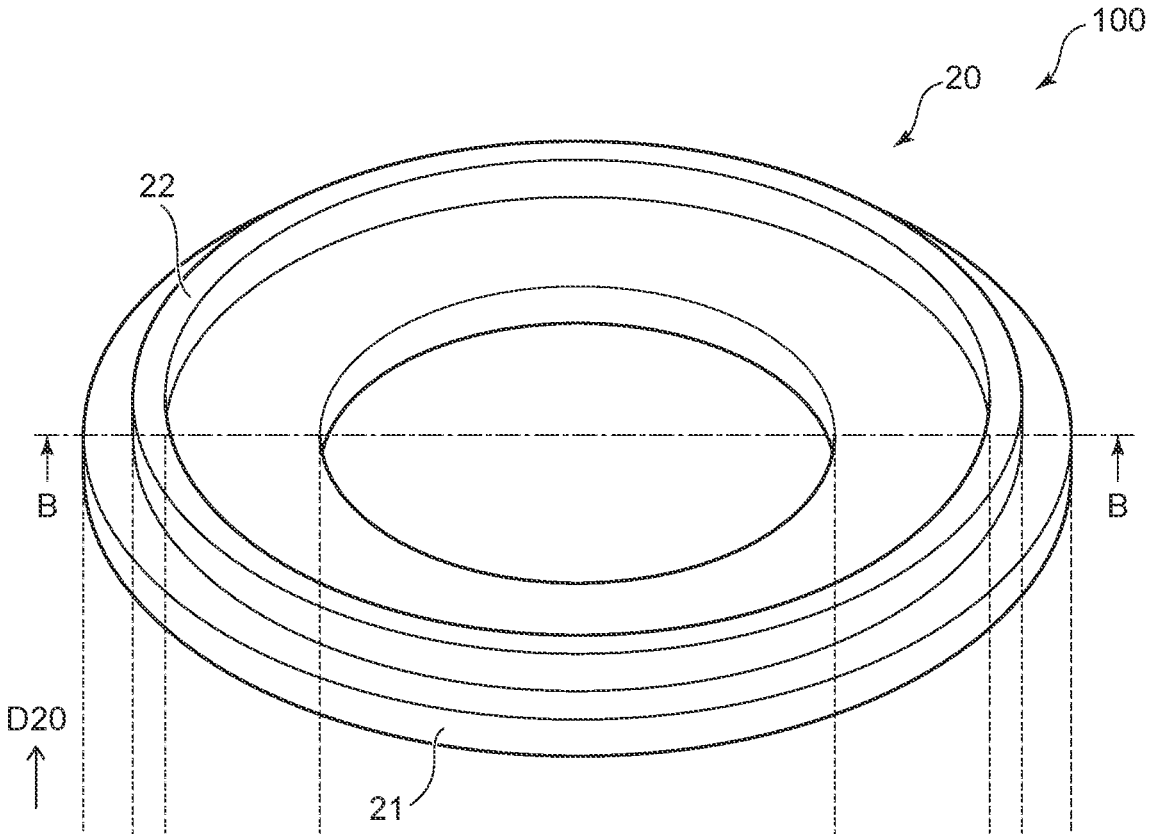
FIGS. 3A and 3B are a schematic perspective view and a schematic cross-sectional view illustrating the cover member of the semiconductor device manufacturing jig according to the embodiment.
Figure 3B:
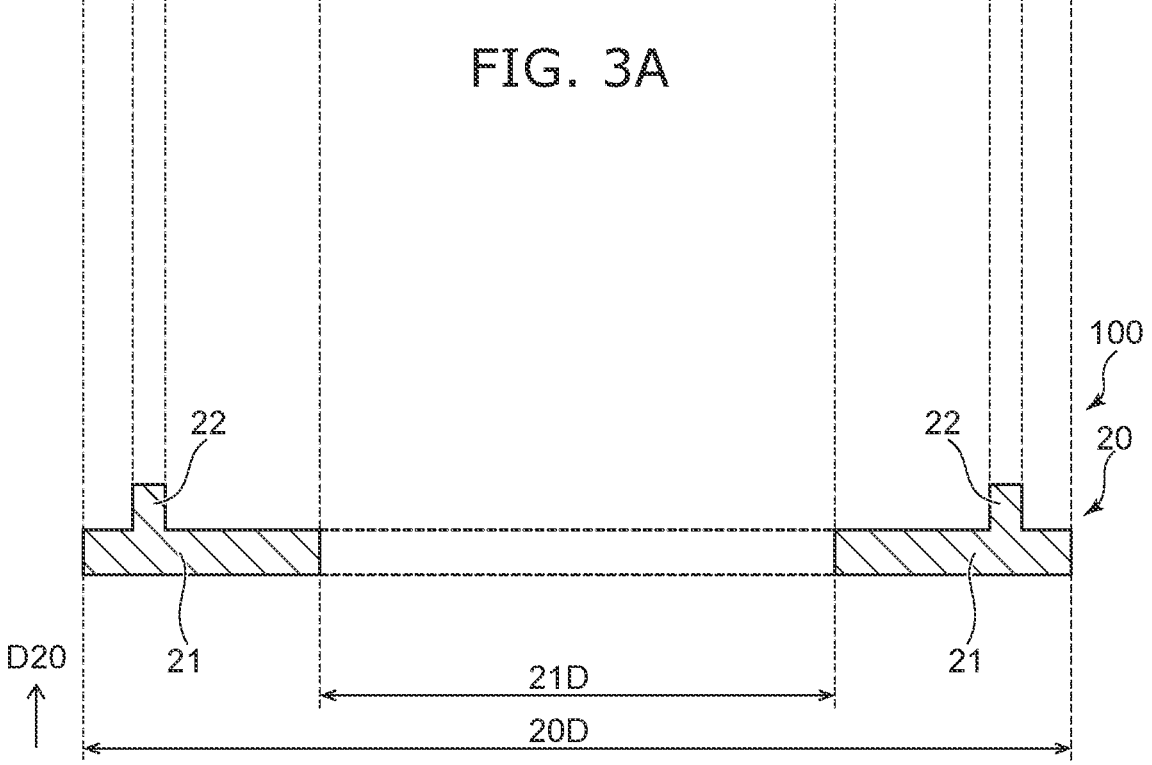

FIGS. 3A and 3B are a schematic perspective view and a schematic cross-sectional view illustrating the cover member of the semiconductor device manufacturing jig according to the embodiment.

FIG. 3B is a line B-B cross section of FIG. 3A. As illustrated in FIGS. 3A and 3B, the cover member 20 includes a ring part 21 and a protrusion 22.

The ring part 21 is ring-shaped when viewed along a direction D20. The protrusion 22 protrudes from the ring part 21 in the direction D20. The protrusion 22 has a continuous ring shape around the entire perimeter of the ring part 21. The protrusion 22 corresponds to the groove 13*g* of the conductive member 10. However, according to the embodiment, the protrusion 22 may not always be provided. For example, an insulator such as a resin or the like is used as the material of the cover member 20.

Figure 4A:
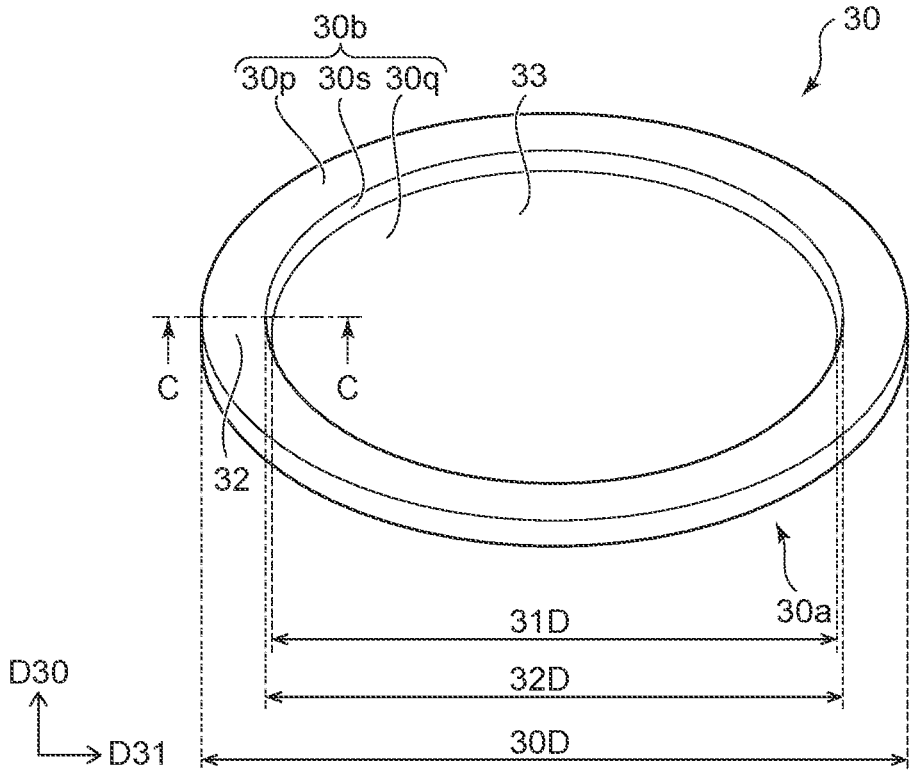
FIGS. 4A and 4B are a schematic perspective view and a schematic cross-sectional view illustrating the substrate to be processed by electroplating using the semiconductor device manufacturing jig according to the embodiment.
Figure 4B:
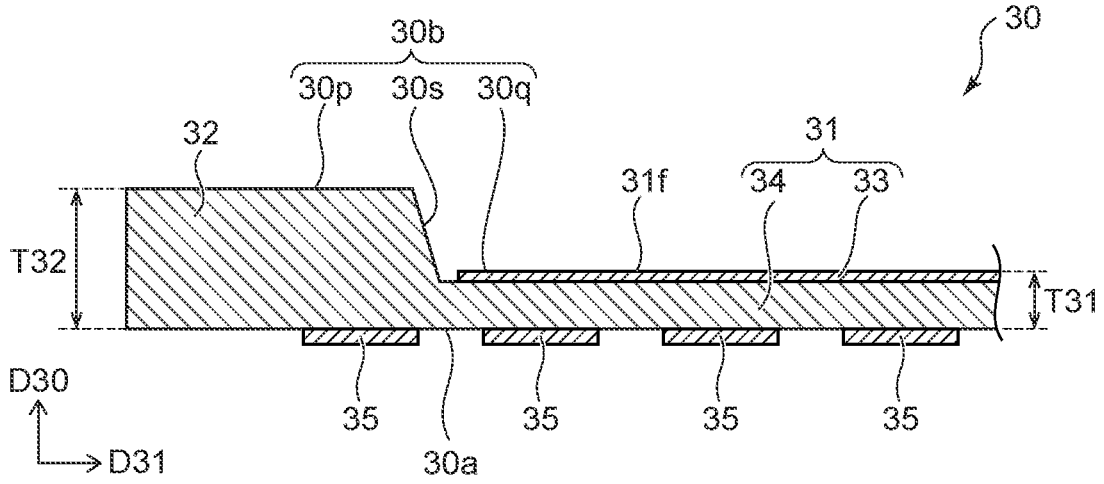

FIGS. 4A and 4B are a schematic perspective view and a schematic cross-sectional view illustrating the substrate to be processed by electroplating using the semiconductor device manufacturing jig according to the embodiment.

FIG. 4B is a line C-C cross section of FIG. 4A. The substrate 30 that is to be processed by the plating process includes a front surface 30*a* (the lower surface in FIG. 4B) and a back surface 30*b* (the upper surface in FIG. 4B). The back surface 30*b* is at the side opposite to the front surface 30*a*.

A portion of a semiconductor element is formed at the front surface 30*a* side. In the example of FIG. 4B, a semiconductor pattern 35 that is a portion of the semiconductor element is formed on the front surface 30*a*. The semiconductor element that is provided in the substrate 30 is, for example, a vertical MOSFET (Metal Oxide Semiconductor Field Effect Transistor); and the semiconductor pattern 35 is a source electrode or a gate electrode of the MOSFET. The semiconductor pattern 35 may include a protective layer of the semiconductor element. However, according to the embodiment, the semiconductor element that is provided in the substrate 30 is not always a MOSFET and may be any semiconductor element such as an IGBT (Insulated Gate Bipolar Transistor), a diode, etc.

The front surface 30*a* is, for example, a plane. On the other hand, the back surface 30*b* includes a larger unevenness than the front surface 30*a*. Specifically, the substrate 30 includes an inner part 31 (a membrane) that is recessed, and an outer rim part 32 (a rim) that is a protrusion. As illustrated in FIG. 4B, the inner part 31 includes a first surface 31*f* that is perpendicular to a direction D30. The inner part 31 is circular when viewed along the direction D30. The outer rim part 32 is located around the inner part 31.

The outer rim part 32 has a ring shape that surrounds the outer perimeter of the inner part 31. The outer rim part 32 protrudes further than the first surface 31*f* in the direction D30. A thickness T32 (the length along the direction D30) of the outer rim part 32 is greater than a thickness T31 of the inner part 31.

In other words, the back surface 30*b* includes a protrusion region 30*p* that is the surface of the outer rim part 32, and a recess region 30*q* that is the surface of the inner part 31. A sloped surface 30*s* is located between the protrusion region 30*p* and the recess region 30*q* of the back surface 30*b*. The sloped surface 30*s* connects the protrusion region 30*p* and the recess region 30*q*. For example, the protrusion region 30*p* and the recess region 30*q* are perpendicular to the direction D30; and the sloped surface 30*s* is tilted with respect to the protrusion region 30*p* and the recess region 30*q*. Thus, a step (an elevation difference) is formed between the inner part 31 and the outer rim part 32. The sloped surface 30*s* may be a side surface that is substantially perpendicular to the protrusion region 30*p*.

As illustrated in FIG. 4B, the inner part 31 includes a semiconductor part 34, and a conductive layer 33 that is located on the semiconductor part 34. The first surface 31*f* is the surface of the conductive layer 33. The conductive layer 33 is located only at the inner part 31 and is separated from the outer rim part 32 and the sloped surface 30*s*. For example, the conductive layer 33 is located at substantially the entire inner part 31. The conductive layer 33 may not be located at the end portion at the outer side of the inner part 31 (the boundary portion with the sloped surface 30*s*). The conductive layer 33 is, for example, a seed layer of the plating process.

The semiconductor part 34 and the outer rim part 32 include, for example, silicon, silicon carbide, gallium nitride, or gallium arsenide as a semiconductor material. For example, a semiconductor element such as a MOSFET or the like is formed by ion-implanting an n-type impurity and a p-type impurity into the semiconductor material. Arsenic, phosphorus, or antimony can be used as the n-type impurity. Boron can be used as the p-type impurity. The gate electrode of the semiconductor element includes, for example, a conductive material such as polysilicon doped with an impurity, etc. The source electrode of the semiconductor element includes, for example, a metal such as aluminum, copper, silver, titanium, tungsten, etc. A protective layer of the semiconductor element includes, for example, an insulating material such as polyimide, etc. The conductive layer 33 includes, for example, at least one of titanium, aluminum, nickel, copper, silver, or tungsten.

Figure 5B:
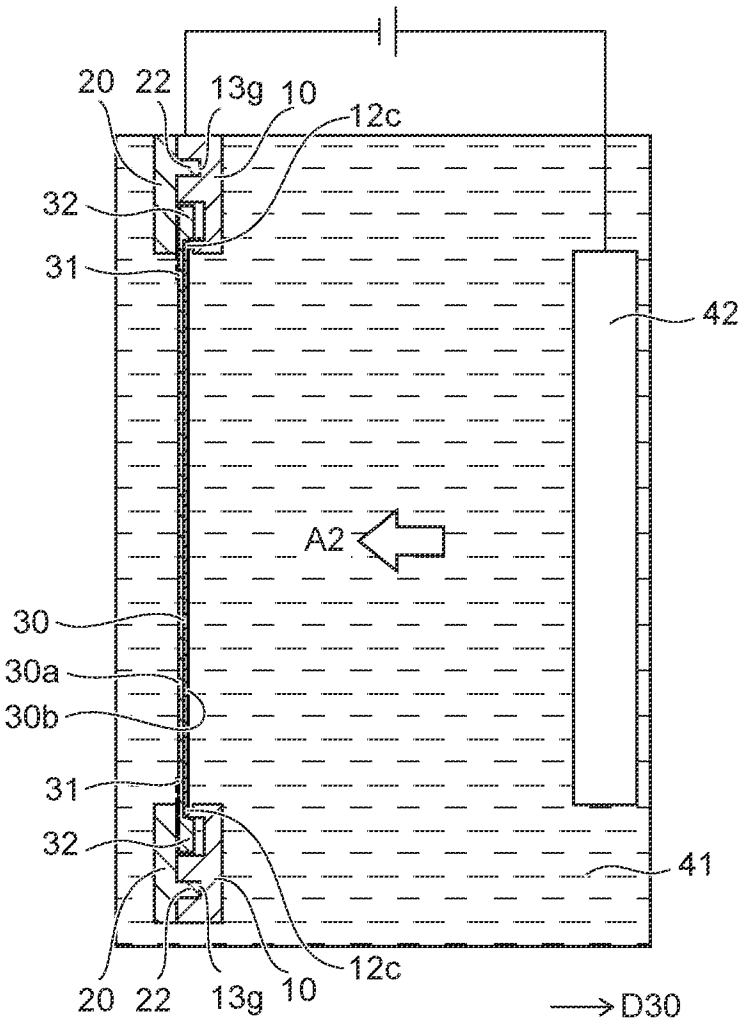
FIGS. 5A and 5B are a schematic plan view and a schematic cross-sectional view illustrating a plating process that uses the semiconductor device manufacturing jig according to the embodiment.
Figure 5A:
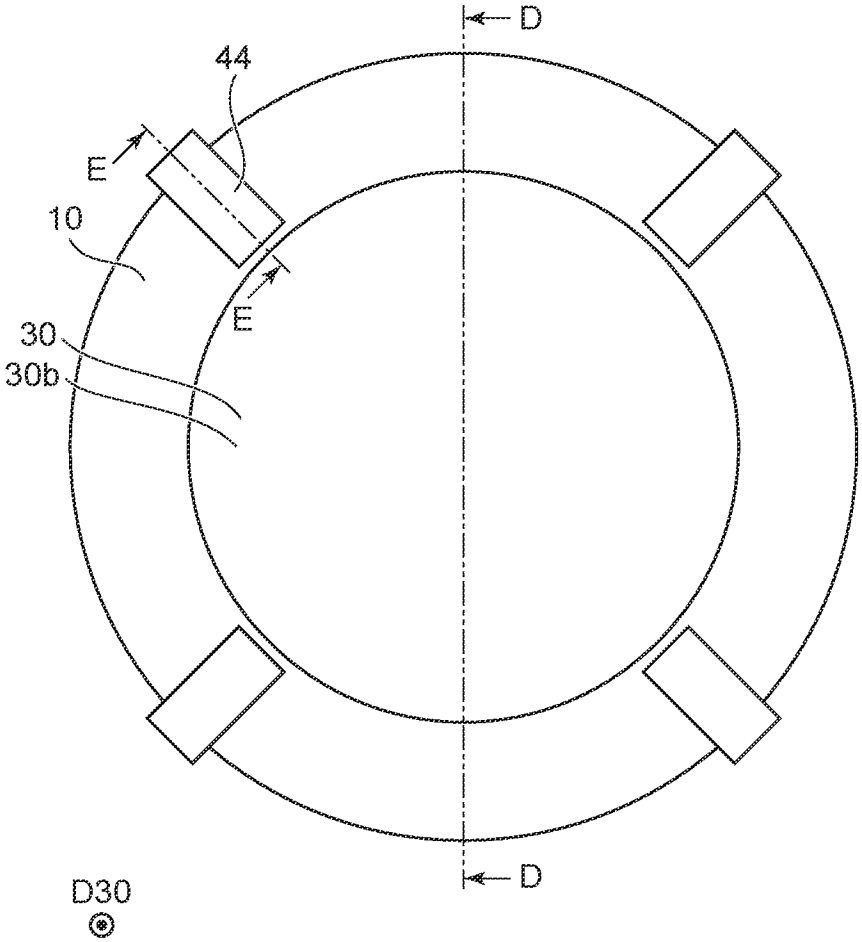

FIGS. 5A and 5B are a schematic plan view and a schematic cross-sectional view illustrating a plating process that uses the semiconductor device manufacturing jig according to the embodiment.

FIG. 5A is a plan view when the semiconductor device manufacturing jig 100 and the substrate 30 illustrated in FIG. 5B are viewed along arrow A2. FIG. 5B corresponds to a line D-D cross section shown in FIG. 5A.

In the plating process as illustrated in FIGS. 5A and 5B, the substrate 30 is clamped by the conductive member 10 and the cover member 20.

Figure 6:
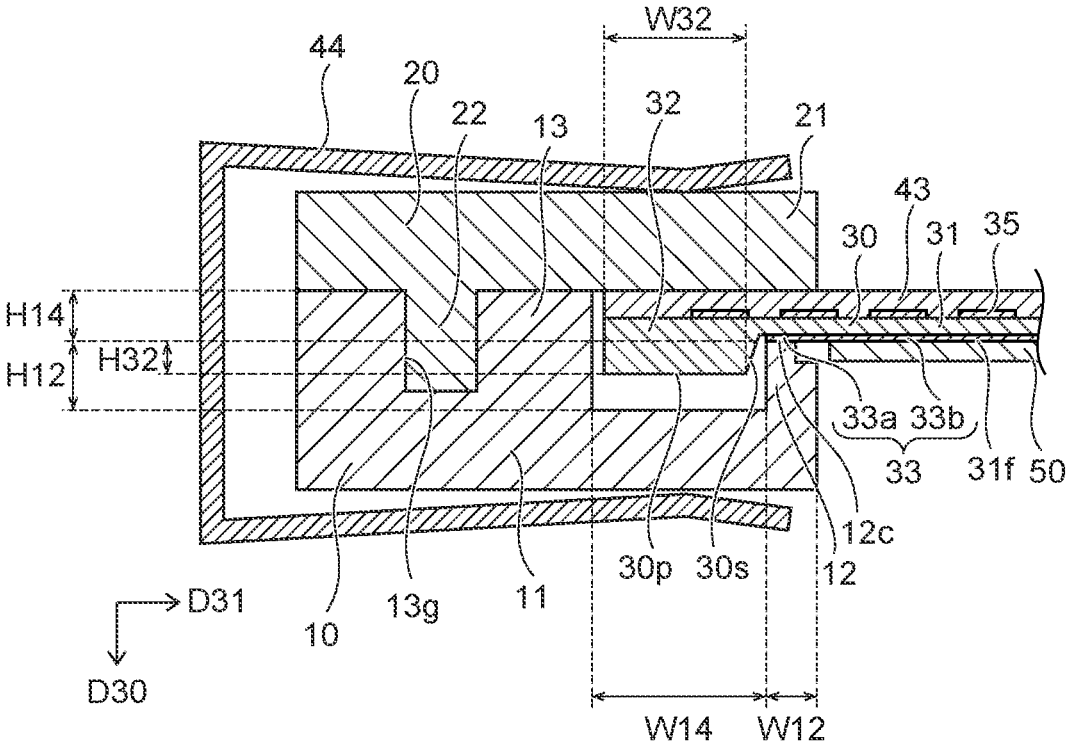
FIG. 6 is a schematic cross-sectional view illustrating a portion of the semiconductor device manufacturing jig according to the embodiment.

FIG. 6 is a schematic cross-sectional view illustrating a portion of the semiconductor device manufacturing jig according to the embodiment. FIG. 6 is a line E-E cross section shown in FIG. 5A.

In the plating process as illustrated in FIG. 6, the conductive member 10 and the cover member 20 engage by the protrusion 22 of the cover member 20 being inserted into the groove 13*g* of the conductive member 10. The relative positions of the conductive member 10 and the cover member 20 are regulated by the protrusion 22 and the groove 13*g*. Also, the inner part 31 of the substrate 30 is supported by the contact part 12*c* and the cover member 20 (the ring part 21). When the substrate 30 is clamped by the groove 13*g* and the protrusion 22 engaging as in FIG. 6, the outer rim part 32 of the substrate 30 is in a state of being located between the second part 12 and the third part 13.

More specifically, the conductive layer 33 includes an outer perimeter portion 33*a* that contacts the contact part 12*c*, and a central portion 33*b* that is surrounded with the outer perimeter portion 33*a*. The outer perimeter portion 33*a* includes the end portion of the conductive layer 33 and has a ring shape that surrounds the central portion 33*b*. In other words, the contact part 12*c* has a ring shape that contacts the outer perimeter portion 33*a* of the conductive layer 33. In the plating process, the contact part 12*c* contacts the surface of the outer perimeter portion 33*a* of the conductive layer 33 (i.e., a portion of the first surface 31*f*) and causes a current to flow in the conductive layer 33.

In the plating process, only the contact part 12*c* of the conductive member 10 contacts the substrate 30. The conductive member 10 does not contact the outer rim part 32 (the sloped surface 30*s* and the protrusion region 30*p*).

A protective tape 43 is adhered on the front surface 30*a* of the substrate 30. The cover member 20 contacts the protective tape 43 and supports the front surface 30*a* side of the substrate 30 via the protective tape 43. The cover member 20 (the ring part 21) overlaps the contact part 12*c* in the direction D30 and clamps the inner part 31 of the substrate 30 with the contact part 12*c*.

A width W12 (the length in a direction D31 that is perpendicular to the direction D30) of the second part 12 is, for example, not less than 1.0 mm and not more than 3.0 mm. A length W14 in the direction D31 between the second part 12 and the third part 13 is greater than a width W32 (the length along the direction D31) of the outer rim part 32. The length W14 is, for example, not less than 2.5 mm and not more than 4.5 mm. A height H12 of the second part 12 (the length of the protrusion from the first part 11) is greater than a difference H32 between the thickness of the outer rim part 32 and the thickness of the inner part 31. The height H12 is, for example, not less than 0.7 mm and not more than 1.0 mm. A difference H14 between the height of the second part 12 and the height of the third part 13 is substantially equal to the sum of the thickness of the inner part 31 and the thickness of the protective tape 43.

An inner diameter 10D of the conductive member 10 (referring to FIG. 2A) is less than an outer diameter 30D of the substrate 30 (referring to FIG. 4A). An inner diameter 13D of the third part 13 of the conductive member 10 (referring to FIG. 2A) is greater than the outer diameter 30D of the substrate 30. An outer diameter 12D of the second part of the conductive member 10 (referring to FIG. 2A) is less than an inner diameter 32D of the outer rim part 32 (referring to FIG. 4A). The outer diameter 12D of the second part 12 is less than an outer diameter 31D of the inner part 31 (referring to FIG. 4A). An outer diameter 20D of the cover member 20 is greater than the outer diameter 30D of the substrate 30. An inner diameter 21D of the cover member 20 (referring to FIG. 3B) is less than the inner diameter 32D of the outer rim part 32.

The conductive member 10 and the cover member 20 are fixed by being clamped by a clip 44 that is made of, for example, a resin in a state in which the conductive member 10 and the cover member 20 clamp the substrate 30.

As illustrated in FIG. 5B, the substrate 30 that is clamped by the conductive member 10 and the cover member 20 is immersed together with an anode electrode 42 in a plating liquid 41. The anode electrode 42 and the back surface 30*b* of the substrate 30 are disposed to face each other via the plating liquid 41. Then, a current flows in the conductive layer 33 of the inner part 31 via the contact part 12*c* when a voltage is applied between the conductive member 10 and the anode electrode 42. Thereby, as illustrated in FIG. 6, a metal film 50 is formed on the central portion 33*b* of the conductive layer 33. In the plating process, the metal film 50 is formed at the first surface 31*f* of the inner part 31. In the plating process, for example, the conductive layer 33 functions as a cathode electrode. The metal film 50 includes, for example, at least one of silver, copper, nickel, or tin.

FIGS. 7A to 7H are schematic cross-sectional views in order of the processes, illustrating a method for manufacturing the semiconductor device according to the embodiment.

Figures 7A, 7B, 7C, 7D, 7E, 7F, 7G, 7H:
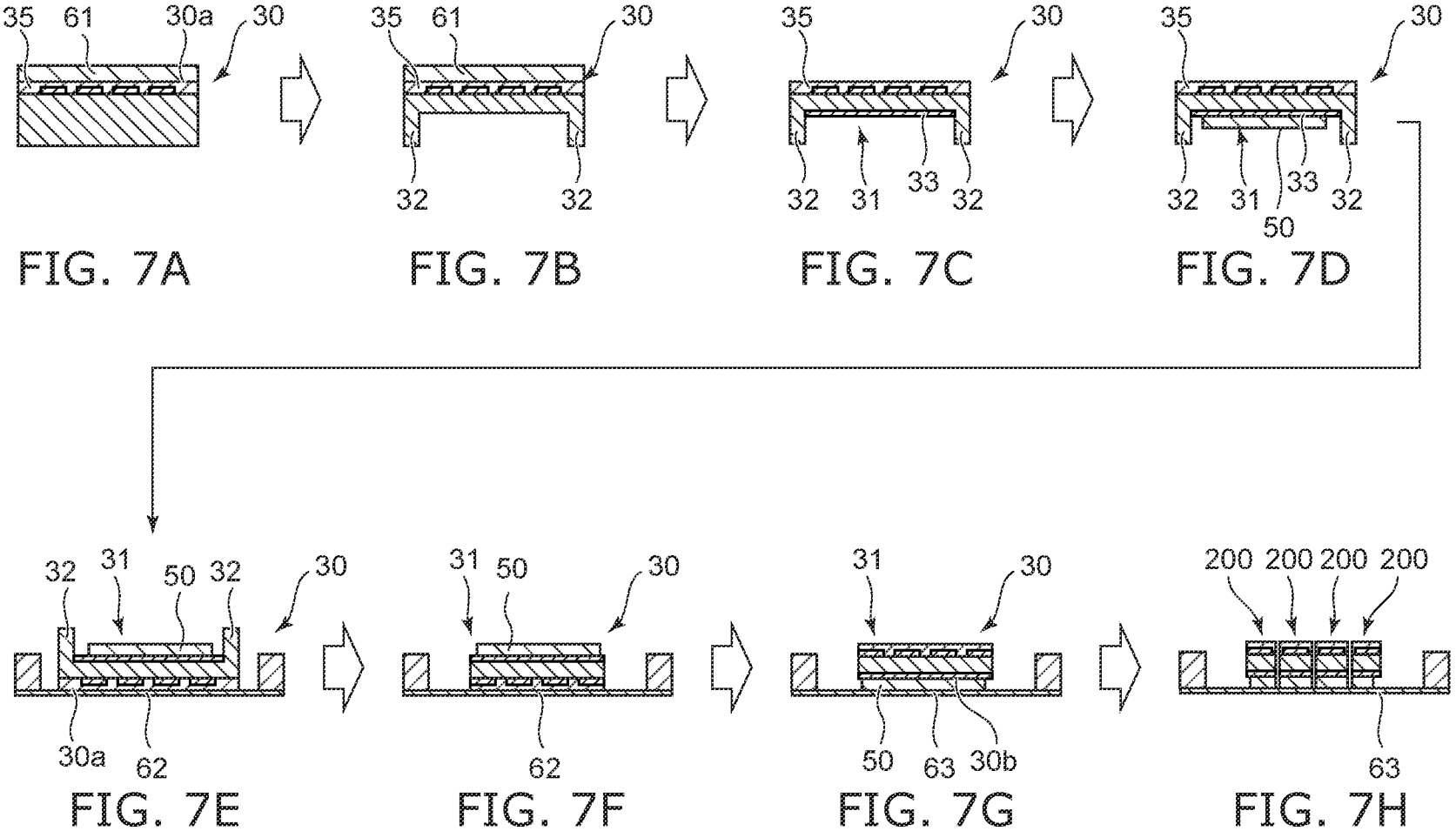
FIGS. 7A to 7H are schematic cross-sectional views in order of the processes, illustrating a method for manufacturing the semiconductor device according to the embodiment.

As illustrated in FIG. 7A, a backgrinding tape 61 is adhered to the front surface 30*a* of the substrate 30 at which the semiconductor pattern 35 is formed.

As illustrated in FIG. 7B, the central portion of the backside of the substrate 30 (the portion other than the outer perimeter portion of the substrate 30) is thinned by polishing; and wet etching of the backside is performed (a thinning process). The outer rim part 32 is formed thereby. A fracture layer that forms when polishing is removed by wet etching the backside.

The backgrinding tape 61 is peeled as illustrated in FIG. 7C. Subsequently, for example, the conductive layer 33 is formed by sputtering on the central portion (substantially the entire surface other than the outer perimeter portion of the backside of the substrate 30) that was thinned by the thinning process of the backside (an electrode formation process). The inner part 31 of the substrate 30 is formed thereby. In the electrode formation process, the conductive layer 33 may not be formed at the protrusion region 30*p* and/or the sloped surface 30*s* shown in FIG. 6.

As illustrated in FIG. 7D, the metal film 50 is formed on the conductive layer 33 of the substrate 30 (a plating process). The method that is described with reference to FIGS. 5A and 5B and FIG. 6 is used in the plating process.

As illustrated in FIG. 7E, a dicing tape 62 is adhered to the front surface 30*a* side (a tape adhesion process). As illustrated in FIG. 7F, the outer perimeter portion that includes the outer rim part 32 of the substrate 30 is removed using a dicing blade (a cutting process).

As illustrated in FIG. 7G, tape 63 is adhered to the metal film 50 at the back surface 30*b* side; and the dicing tape 62 is peeled (a tape transfer process).

As illustrated in FIG. 7H, the substrate 30 is regulated by dicing (a dicing process). The semiconductor device 200 is formed thereby.

Figure 8:
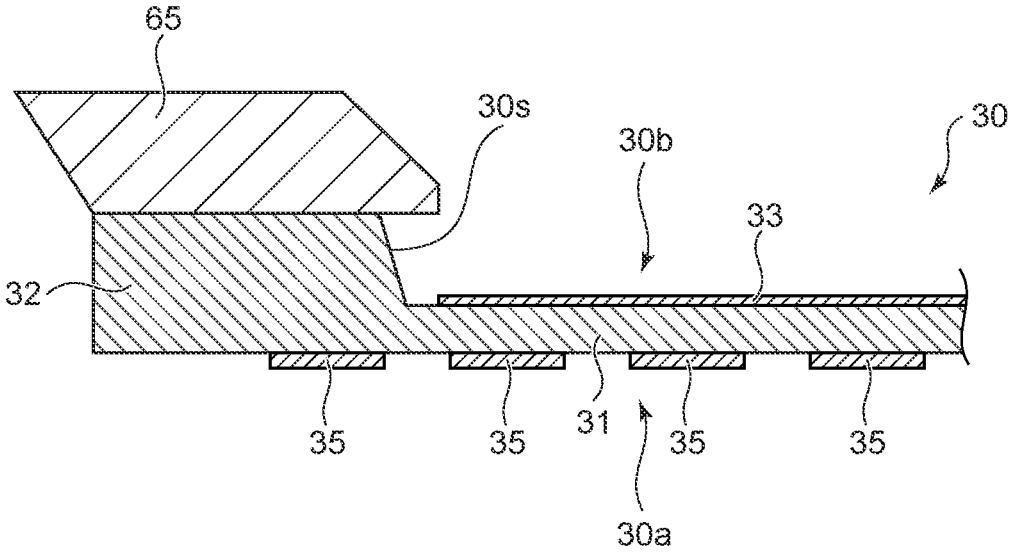
FIG. 8 is a schematic cross-sectional view illustrating the method for manufacturing the semiconductor device according to the embodiment.

FIG. 8 is a schematic cross-sectional view illustrating the method for manufacturing the semiconductor device according to the embodiment.

FIG. 8 illustrates the electrode formation process described with reference to FIG. 7C. For example, an edge clamp-type sputtering apparatus can be used in the electrode formation process. A clamp 65 of the sputtering apparatus contacts the outer rim part 32 and covers the outer rim part 32 and the sloped surface 30*s*. Sputtering of the back surface 30*b* side of the substrate 30 is performed in this state. Thereby, the conductive layer 33 is formed only at the inner part 31.

Figure 9A:
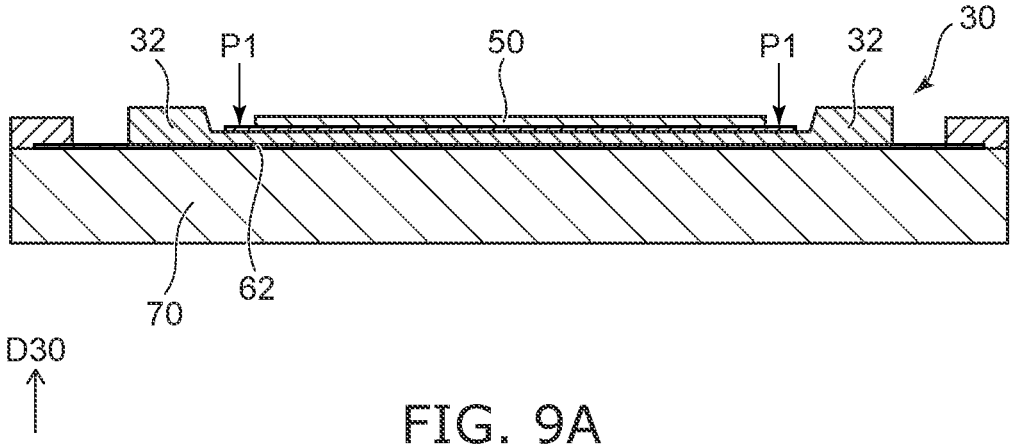
FIGS. 9A and 9B are schematic cross-sectional views illustrating the method for manufacturing the semiconductor device according to the embodiment.
Figure 9B:
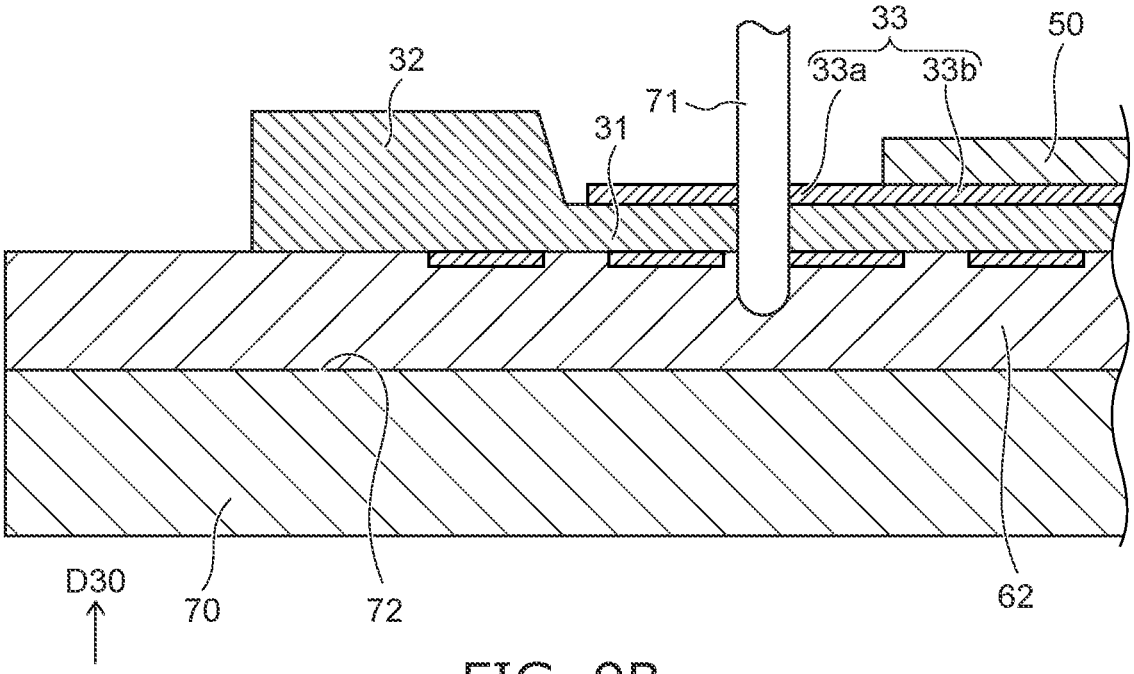

FIGS. 9A and 9B are schematic cross-sectional views illustrating the method for manufacturing the semiconductor device according to the embodiment.

FIGS. 9A and 9B illustrate the cutting process described with reference to FIG. 7F. The vicinity of a cut position P1 shown in FIG. 9A is enlarged in FIG. 9B. In the cutting process, the substrate 30 is placed on a chuck table 70 and is cut in the thickness direction at the cut position P1 by a dicing blade 71.

In a plane perpendicular to the direction D30, the cut position P1 is the position of a portion (i.e., the outer perimeter portion 33*a*) of the inner part 31 contacted by the contact part 12*c* of the conductive member 10 in the plating process. The cut position P1 is circular when viewed along the direction D30.

Effects according to the embodiment will now be described.

Figure 10:
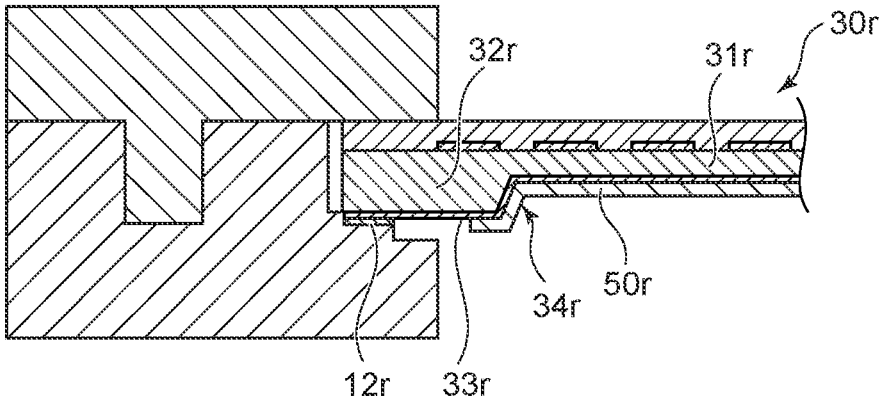
FIG. 10 is a schematic cross-sectional view illustrating a method for manufacturing a semiconductor device according to a reference example.

FIG. 10 is a schematic cross-sectional view illustrating a method for manufacturing a semiconductor device according to a reference example.

FIG. 10 shows a plating process of electroplating a substrate 30*r* that includes a membrane 31*r* and a rim 32*r* surrounding the membrane 31*r*. In the reference example, a conductive layer 33*r* that is used as a seed layer is formed on the membrane 31*r* and the rim 32*r*. A conductive contact part 12*r* of the jig contacts the conductive layer 33*r* on the rim 32*r*. In the plating process, a current flows from the contact part 12*r* of the jig into the conductive layer 33*r* that is located at the rim 32*r* and the membrane 31*r*. In such a case, a metal film 50*r* that is formed by the plating is formed not only on the membrane 31*r* but also on the rim 32*r* and a rim end portion 34*r* (the boundary between the membrane 31*r* and the rim 32*r*). In the reference example, there is a risk that the stress of the metal film 50*r* may concentrate at the rim end portion 34*r*, and cracking of the substrate may occur more easily.

Conversely, according to the embodiment as described with reference to FIG. 6, the contact part 12*c* of the conductive member 10 contacts a portion of the first surface 31*f* of the inner part 31 and causes a current to flow in the inner part. The flow of the current in the outer rim part 32 and in the end portion of the outer rim part 32 (the boundary between the inner part 31 and the outer rim part 32) can be suppressed thereby. Accordingly, the formation of the metal film 50 at the outer rim part 32 and at the end portion of the outer rim part 32 can be suppressed. The stress concentration due to the metal film 50 at the end portion of the outer rim part 32 can be suppressed; therefore, substrate cracks can be suppressed.

The conductive member 10 does not contact the outer rim part 32 in the plating process. Thereby, the formation of the metal film 50 at the outer rim part 32 and at the end portion of the outer rim part 32 is suppressed because the flow of the current in the outer rim part 32 and in the end portion of the outer rim part 32 is suppressed.

The conductive layer 33 is located only at the inner part 31. The contact part 12*c* has a ring shape that contacts the outer perimeter portion 33*a* of the conductive layer 33. Thereby, for example, the metal film 50 can be formed only on the central portion 33*b* of the conductive layer 33 (the portion other than the outer perimeter portion 33*a* of the conductive layer 33); and the formation of the metal film 50 at the outer perimeter portion 33*a* and at the outer side of the outer perimeter portion 33*a* can be suppressed. In other words, the formation of the metal film 50 at the outer rim part 32 and at the end portion of the outer rim part 32 can be suppressed.

In the plating process, the cover member 20 overlaps the contact part 12*c* in the direction D30 and clamps the substrate 30. By fixing the conductive member 10 and such a cover member 20 by clamping by the clip 44, the substrate 30 can be stably supported, the contact part 12*c* and the first surface 31*f* can be closely adhered, and the metal film 50 can be stably formed.

As described with reference to FIGS. 9A and 9B, the cut position P1 in the cutting process is the portion of the inner part 31 that is contacted by the contact part 12*c* in the plating process. Therefore, for example, the cutting is easy because the metal film 50 is not formed at the cut position P1. For example, clogging of the dicing blade 71 due to cutting the metal film can be suppressed, and chipping can be suppressed.

For example, when the semiconductor element that is provided in the substrate 30 is a vertical MOSFET, the metal film 50 performs the role of a drain electrode. For example, when the semiconductor device is a shared-drain-electrode MOSFET, a current flows between two MOSFETs via the drain electrode (the metal film 50). In such a case, it is desirable for the metal film 50 to be thick. The resistance of the drain electrode can be reduced thereby, and the on-resistance of the semiconductor elements can be reduced. On the other hand, when the metal film 50 is thick, the stress that the metal film 50 applies to the substrate 30 may increase. In such a case as well, according to the embodiment, the formation of the metal film 50 at the outer rim part 32 and at the end portion of the outer rim part 32 can be suppressed; therefore, substrate cracks can be suppressed.

When the metal film that is cut by the dicing blade is thick, there is a risk that clogging of the dicing blade and chipping may easily occur. Conversely, according to the embodiment, for example, the metal film 50 is not formed at the cut position P1 in the cutting process; therefore, chipping can be suppressed even when the metal film 50 is thick.

For example, when the semiconductor element that is provided in the substrate 30 is a vertical MOSFET, the on-resistance can be reduced by thinning the inner part 31. On the other hand, when the inner part 31 is thinned, there is a risk that the strength of the substrate may decrease. Conversely, according to the embodiment, the chipping in the cutting process can be suppressed as described above; therefore, the inner part 31 is easily thinned.

According to the embodiment as described above, manufacturing process defects such as substrate cracks, chipping, etc., can be suppressed.

FIGS. 11A to 11G are schematic cross-sectional views in order of the processes, illustrating another method for manufacturing the semiconductor device according to the embodiment.

FIGS. 11A to 11D and FIG. 11G are similar to the description relating to FIGS. 7A to 7D and FIG. 7H.

Figures 11A, 11B, 11C, 11D, 11E, 11F, 11G:
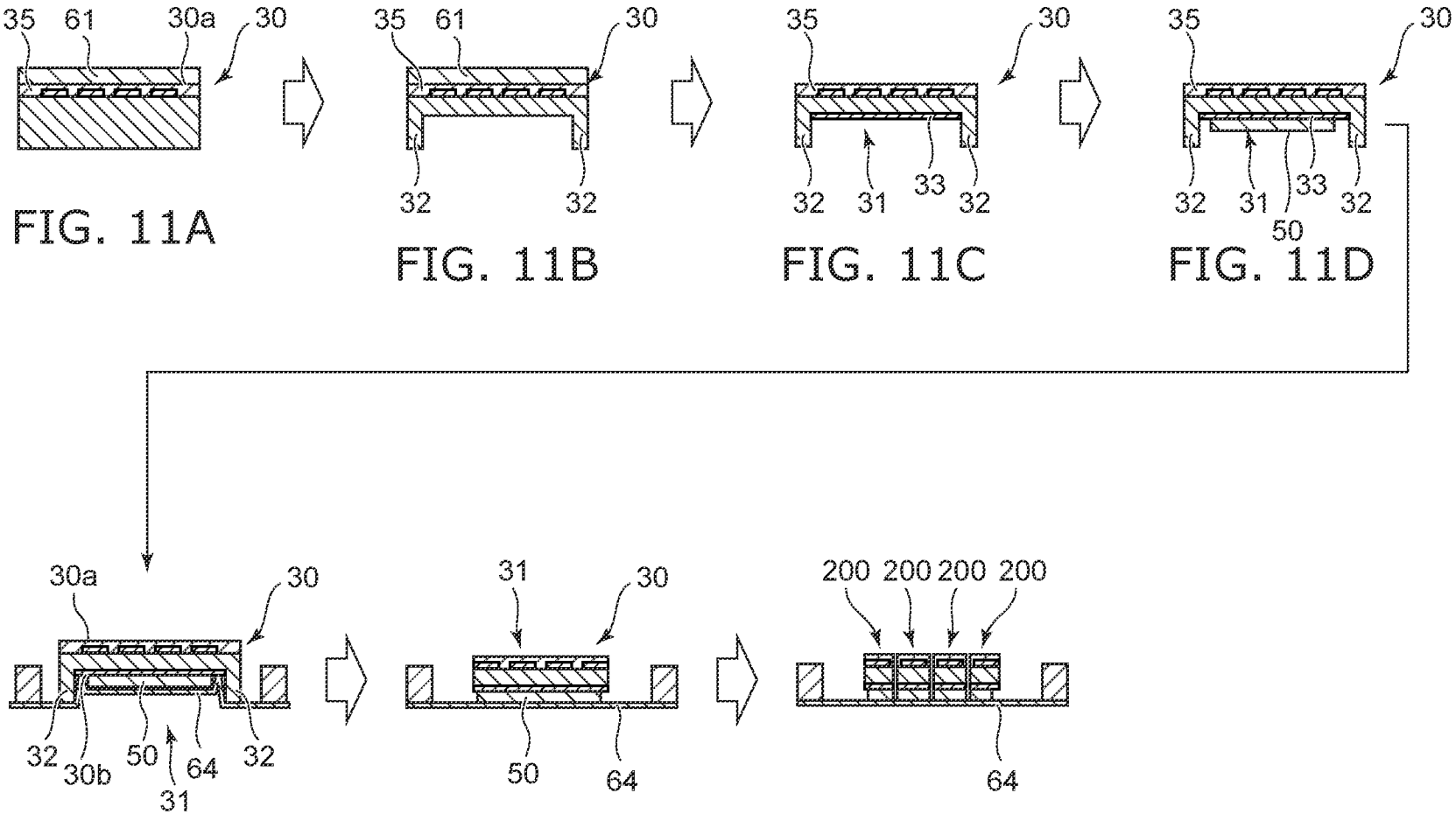
FIGS. 11A to 11G are schematic cross-sectional views in order of the processes, illustrating another method for manufacturing the semiconductor device according to the embodiment.

In the example as illustrated in FIG. 11E, a dicing tape 64 is adhered to the back surface 30*b* and the metal film 50 (a tape adhesion process). Subsequently, as illustrated in FIG. 11F, the outer perimeter portion that includes the outer rim part 32 of the substrate 30 is removed (a cutting process).

Figure 12A:
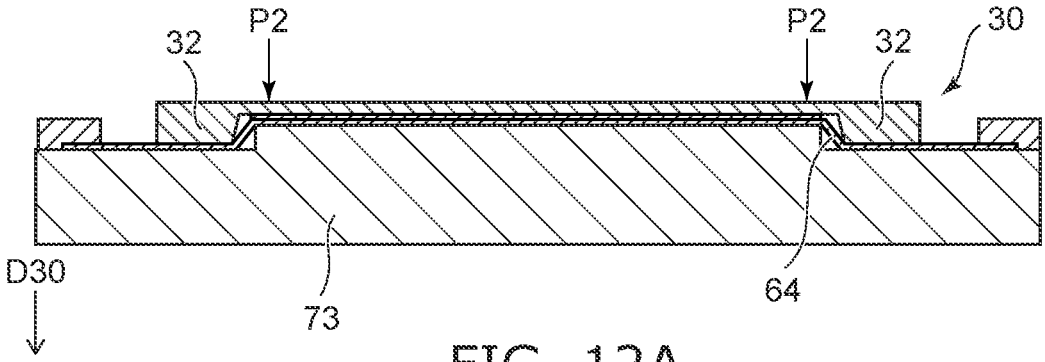
FIGS. 12A and 12B are schematic cross-sectional views illustrating the method for manufacturing the semiconductor device according to the embodiment.
Figure 12B:
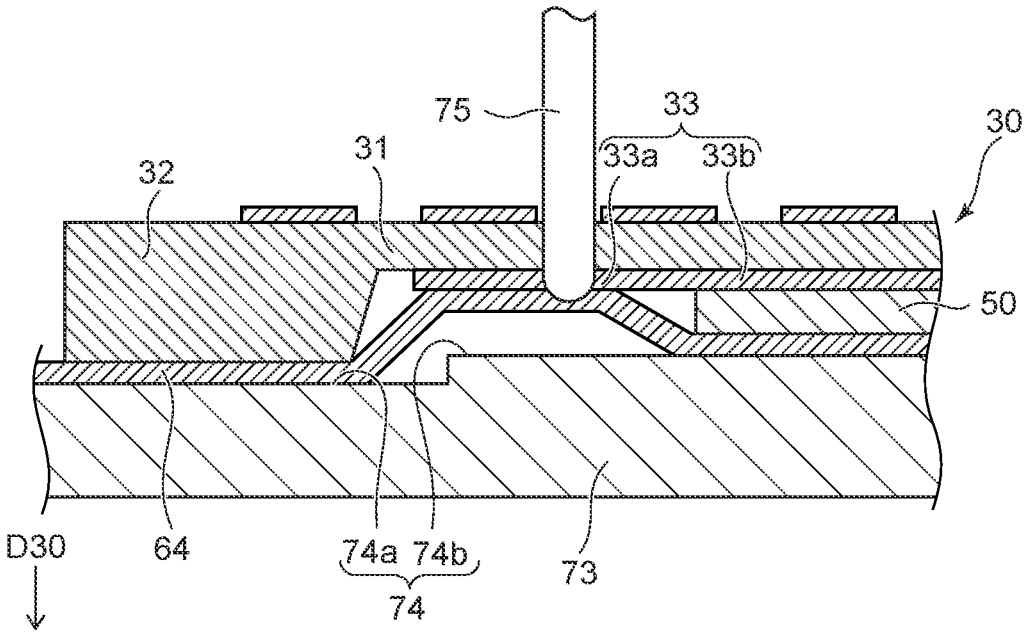

FIGS. 12A and 12B are schematic cross-sectional views illustrating the method for manufacturing the semiconductor device according to the embodiment.

FIGS. 12A and 12B illustrate the cutting process described with reference to FIG. 11F. The vicinity of a cut position P2 shown in FIG. 12A is enlarged in FIG. 12B. The conductive layer 33 is not illustrated in FIG. 12A. In the cutting process, the substrate 30 that is placed on a chuck table 73 is cut in the thickness direction at the cut position P2 by a dicing blade 75.

As illustrated in FIG. 12B, a step that corresponds to the elevation difference between the inner part 31 and the outer rim part 32 is provided at a placement part 74 of the chuck table 73 where the substrate 30 is placed. The placement part 74 includes a region 74*a* that is positioned below the outer rim part 32, and a region 74*b* that is positioned below the inner part 31. The region 74*b* protrudes further than the region 74*a* toward the inner part 31.

In a plane perpendicular to the direction D30, the cut position P2 is the position of a portion of the inner part 31 (i.e., the outer perimeter portion 33*a*) that is contacted by the contact part 12*c* of the conductive member 10 in the plating process. The cut position P2 is circular when viewed along the direction D30.

Thus, the substrate 30 may be cut from the front surface 30*a* side by adhering a dicing tape to the back surface 30*b* side of the substrate 30. In such a case, a tape transfer process such as that described with reference to FIG. 7G is unnecessary.

On the other hand, as described with reference to FIG. 9B, the effects of the elevation difference between the inner part 31 and the outer rim part 32 can be suppressed when a dicing tape is adhered to the front surface 30*a* side of the substrate 30 and when the substrate 30 is cut from the back surface 30*b*. For example, a placement surface 72 of the chuck table 70 illustrated in FIG. 9B where the substrate 30 is placed is substantially flat. For example, the substrate 30 is easily cut even when the elevation difference between the inner part 31 and the outer rim part 32 changes due to manufacturing fluctuation.

According to embodiments, a semiconductor device manufacturing jig and a method for manufacturing a semiconductor device can be provided in which manufacturing process defects can be suppressed.

In the specification of the application, "perpendicular" refers to not only strictly perpendicular but also include, for example, the fluctuation due to manufacturing processes, etc. It is sufficient to be substantially perpendicular.

Hereinabove, exemplary embodiments of the invention are described with reference to specific examples. However, the embodiments of the invention are not limited to these specific examples. For example, one skilled in the art may similarly practice the invention by appropriately selecting specific configurations of components included in semiconductor device manufacturing jigs from known art. Such practice is included in the scope of the invention to the extent that similar effects thereto are obtained.

Further, any two or more components of the specific examples may be combined within the extent of technical feasibility and are included in the scope of the invention to the extent that the purport of the invention is included.

Moreover, all semiconductor device manufacturing jigs, and methods for manufacturing semiconductor devices practicable by an appropriate design modification by one skilled in the art based on the semiconductor device manufacturing jigs, and the methods for manufacturing semiconductor devices described above as embodiments of the invention also are within the scope of the invention to the extent that the purport of the invention is included.

Various other variations and modifications can be conceived by those skilled in the art within the spirit of the invention, and it is understood that such variations and modifications are also encompassed within the scope of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A semiconductor device manufacturing jig for electroplating a substrate, the substrate including:

an inner part including a first surface and a second surface, the second surface being opposite to the first surface; and an outer rim part surrounding the inner part, the outer rim part having a ring shape that protrudes further than the first surface in a direction perpendicular to the first surface, the jig comprising a conductive member and a cover member, the substrate being clamped between the conductive member and the cover member, the conductive member causing a current to flow in the inner part by contacting a portion of the first surface of the inner part without contacting the outer rim part, the conductive member including a contact part that contacts the portion of the first surface and, the cover member having a ring shape, the cover member contacting the second surface of the inner part of the substrate at a side opposite to the first surface, the conductive member having a groove that provides a space between the conductive member and the cover member, the outer rim part of the substrate being positioned in the space when the substrate is clamped between the conductive member and the cover member.

2. The jig according to claim 1, wherein the first surface is a surface of a conductive layer located at the inner part, and the contact part of the conductive member has a ring shape contacting an outer perimeter portion of the conductive layer.

3. The jig according to claim 1, wherein the conductive member includes:

a first part;

a second part protruding in a first direction from the first part, the second part being the contact part that includes an end portion in the first direction, the end portion of the contact part contacting the portion of the first surface; and a third part protruding in the first direction from the first part, the third part being separated from the second part in a direction perpendicular to the first direction, the groove of the conductive member being provided between the second part and the third part.

4. The jig according to claim 1, wherein the cover member includes an end portion overlapping the contact part in a direction perpendicular to the first surface.

5. The jig according to claim 1, wherein the contact part is provided with a stepped end contacting the first surface of the substrate.

6. The jig according to claim 1, wherein the conductive member and the cover member each are provided with a circular opening in which the inner part of the substrate is exposed when the substrate is clamped between the conductive member and the cover member.

7. A semiconductor device manufacturing jig for electroplating a substrate, the substrate including an inner part and an outer rim part, the inner part including a first surface, the outer rim part surrounding the inner part and having a ring shape that protrudes further than the first surface in a direction perpendicular to the first surface, the jig comprising:

a conductive member causing a current to flow in the inner part by contacting a portion of the first surface of the inner part without contacting the outer rim part; and a cover member contacting a surface of the inner part at a side opposite to the first surface, the conductive member including first to third parts, the second part of the cover member protruding in a first direction from the first part of the cover member, the second part being a contact part that includes an end portion in the first direction, the end portion of the contact part contacting the portion of the first surface, the third part of the conductive member protruding in the first direction from the first part, the third part being separated from the second part in a direction perpendicular to the first direction, the third part of the conductive member including a groove, the cover member including a protrusion inserted into the groove of the conductive member, when the protrusion is inserted into the groove, the cover member and the conductive member clamp the substrate in a state in which the outer rim part is located between the second part and the third part of the conductive member.

8. The jig according to claim 7, wherein the first surface is a surface of a conductive layer located at the inner part, and the second part of the cover member has a ring shape contacting an outer perimeter portion of the conductive layer.

9. The jig according to claim 7, wherein the end portion of the contact part of the conductive member is provided with a step.

10. The jig according to claim 7, wherein the conductive member and the cover member each are provided with a circular opening in which the inner part of the substrate is exposed when the substrate is clamped between the conductive member and the cover member.

* * * * *